US005732520A

United States Patent [19]

Maietta

[11] Patent Number: 5,732,520

[45] Date of Patent: Mar. 31, 1998

[54] SYNTHETIC STUCCO SYSTEM

[75] Inventor: David D. Maietta, Cota de Casa, Calif.

[73] Assignee: Multicoat Corporation, Costa Mesa, Calif.

[21] Appl. No.: 779,283

[22] Filed: Dec. 10, 1996

[51] Int. Cl.[6] ..... E04B 2/56; E04B 2/84

[52] U.S. Cl. ..... 52/483.1; 52/272; 52/393; 52/741.41; 52/745.05; 52/745.1; 52/745.13

[58] Field of Search ..... 52/272, 393, 741.41, 52/745.05, 745.1, 745.09, 745.13, 483.1, 582.1, 309.7

[56] References Cited

U.S. PATENT DOCUMENTS 1,691,402 11/1928 Oden .
2,078,049 4/1937 Benedict .
3,455,077 7/1969 Long .
3,910,000 10/1975 Kelsey .
4,115,501 9/1978 Yano .
4,525,965 7/1985 Woelfel .
4,680,907 7/1987 Williams .
4,856,244 8/1989 Clapp ..... 52/309.7
5,129,628 7/1992 Vesper ..... 52/309.7 X
5,231,811 8/1993 Andrepont .

*Primary Examiner*—Christopher Kent
*Attorney, Agent, or Firm*—Fulwider Patton Lee & Utecht, LLP

[57] ABSTRACT

A method for forming single coat synthetic stucco finished exterior walls. Cementitious fiber wall board panels are installed on a building frame with the adjacent edges of the panels forming narrow gaps. Polyurethane caulk is applied to the gaps, and low profile fabric backed joint sealant tape is applied over adjacent edges of the panels to cover the gaps and the caulk therein. A high build flexible resinous latex emulsion is next applied directly over the panels and adhesive tape to form a synthetic stucco finish.

20 Claims, 3 Drawing Sheets

SYNTHETIC STUCCO SYSTEM

BACKGROUND OF THE INVENTION

1. Field of the Invention

The present invention relates to synthetic stucco facings for buildings, and more particularly to synthetic stucco facings consisting of a flexible high build resinous latex emulsion applied to cementitious wall boards.

2. Description of the Prior Art

Food and shelter have always been the two most primal needs of mankind, and both have undergone a great deal of change since the dawn of our species. Shelter in particular has come a long way from the spelunking days of the caveman and has run the gamut from straw huts to stone temples, and practically every other possibility in between. The design and construction of commercial and residential buildings have been the subject of much change especially in the past few decades with the advent of a bewildering array of new materials and methods. One of the most popular and widespread innovations of the century is the use of stucco facing on exterior building walls. A stucco facing consists essentially of a mixture of portland cement, sand and sometimes small quantities of lime, applied in a plastic state to form a hard covering for exterior walls. The finish texture of stucco is usually rough and is controlled by the particle size of the mixture components.

The popularity of stucco is easily understood when considered in light of its low material, application, and maintenance costs, pleasing esthetic qualities, and enhanced thermal insulation. Furthermore, because stucco is applied in a plastic state, it can conform to practically any shape. For this very same reason stucco can be mixed in almost any color and can be finished in a variety of patterns, such as brick face or stone. Stucco is environmentally safe and easily lends itself to use by homeowners and other non-professionals.

However, stucco suffers from a number of very serious shortcomings. Because stucco is made up almost exclusively of sand and cement it is porous and quite pervious to moisture. When used in areas with high rain fall, stucco can lead to severe structural damage due to fungus and mildew formation when the underlying substrate is plywood or a similar material, and can cause damage to interior walls when the underlying substrate is a water permeable material such as dry wall. Such damage remains unseen underneath the stucco facing and can go unchecked for many years, thereby gravely compounding the problem. To combat this shortcoming of conventional stucco, moisture barriers have been employed between the stucco facing and the underlying substrate. While their overall performance has been adequate moisture barriers have typically given rise to their own problems, most significantly that of achieving adequate bonding of the stucco to the underlying substrate through the moisture barrier. Solutions devised to correct this problem have been cumbersome and expensive, and typically involved the use of a metal mesh nailed to the substrate through the moisture barrier and holding in place an undercoating of stucco physically bonded to the mesh upon which the final exterior stucco facing is applied. This arrangement is complicated, expensive, and time consuming to implement. Driving nails through the moisture barrier compromises the integrity of the barrier and thus defeats its very purpose. The metal mesh is relatively expensive, and adds substantially to the weight that the walls must support. In addition, the combination of the mesh and the stucco must have substantial integrity independent of the substrate and the stucco facing is accordingly required to be fairly thick, further driving up weight and cost.

Because stucco is water permeable it does not trap water between itself and the underlying substrate but allows it to either drain freely or be absorbed by the underlying substrate. It is obviously preferable to allow water to drain freely and thus special precautions must be taken along openings in the wall such as doors and windows to ensure that water is not absorbed by the wall panels before it has a chance to drain out. Such precautions usually include additional water barriers or flashing, all of which add to the cost and the complexity of the finished structure and thereby detract from the simplicity that is one of the most attractive attributes of stucco. Failure to properly address these shortcomings can result in serious problems for the unsuspecting homeowner, such as wood rot and interior leaks, in as little as two or three years after installation. For these very same reasons stucco is obviously not well suited to use as roofing material, thereby significantly limiting its potential uses.

Stucco is also a very stiff covering and offers relatively mediocre impact resistance. Abrasion resistance is also quite poor, and stucco covering can be scraped off by almost any hand wielded implement. Rigidity is an especially undesirable characteristic when combined with moisture permeability, and for this reason stucco has a limited life span when exposed to repeated freeze/thaw cycles because the water absorbed expands and contracts as it freezes and thaws, and thus creates internal fractures in the stucco facing that grow and allow even more water to infiltrate through to the underlying substrate. Stucco is therefore also not well suited to use in areas subject to freezing temperatures. Although this problem can be combated, it usually entails applying water sealing agents to the outer surface of the stucco finish. This is a costly approach that is not guaranteed to work because all exposed stucco must be fully saturated and because the sealing agents are usually susceptible to UV light, salt spray, and chemicals. Such an approach is also likely to alter the color of the stucco, which is certainly a very undesirable side effect.

The rigidity of stucco also compromises its ability to maintain an attractive exterior surface with the passage of time. It is well known that wall panels tend to shift during the life of the building due to settling and seasonal variations in temperature, and the joints between the panels must therefore accommodate these movements. The traditional solution to this problem is to fill the joint with a caulking compound. However, both hard and soft curing caulking compounds tend to shrink or expand under these circumstances and cannot be depended upon to maintain the water tight seal they were intended to form. In addition, both types of caulk give rise to irregularities on the outer surface of the stucco coat around the joint areas such as cusps or depressions that significantly and permanently alter the outward appearance of the stucco finish. Another well known problem is the formation upon curing of a discontinuance in the appearance of the stucco coat in the areas overlying the panel joints that is caused by uneven water absorption from the stucco mix by the underlying permeable wall panels and the waterproof caulking compound. This problem exhibits itself in a number of ways, such as non-uniform appearance, texture and coloration.

Another solution entails applying a tape over the caulked joints, thus providing a flat surface that is more likely to accommodate the movements of the underlying wall panels and not disturb the overlying materials. Such tapes, however, require a bedding layer in order to adhere to the two adjoining panels, and can sometimes themselves create unsightly bulges on the outer surface of the stucco coat. In addition, joint sealing tapes are typically water proof and do not absorb water from the stucco mix, leading to the surface deformation problems described above.

Stucco is, nevertheless, a very popular construction material and various solutions have been posited for dealing with its shortcomings. It has been proposed, for example, that the wall panels be impregnated with a layer of epoxy upon which a layer of sand can be applied, thereby forming a water resistant layer that offers excellent bonding properties with the stucco mix. While certainly workable, this approach does not eliminate the need for additional coats between the stucco and the underlying substrate and thus is not a cost effective approach. In addition the sand must be applied while the epoxy is still semi-fluid and therefore is likely to require professionally trained laborers utilizing professional, and expensive, equipment. Last but not least, applying sand to a wall is always a messy proposition that necessitates special precautions or costly cleanups.

Another approach calls for the application of an insulation layer upon the wall, followed by a vapor barrier applied as water-based liquid latex or paste, then covered by two coats of stucco. All sorts of reinforcing meshes and bonding adhesives are also suggested as cures for any practical shortcomings this particular invention may exhibit. Although the use of a synthetic stucco mix comprising an acrylic based latex polymer is enumerated, the total number of layers for the finished wall has now increased to four, with a corresponding increase in cost and complexity. While this approach is probably very successful for the fluids storage structures for which it is intended, it is certainly not the simple, elegant, cost effective solution desperately needed by homeowners and real estate developers alike.

Yet another proposed solution separates the exterior coating from the underlying wall panels in the vicinity of the panel joints, thereby theoretically insulating the exterior covering from the underlying joint movements and the displacement of the caulking compound filing the joint. This is a partial solution because it only addresses the problem of joint displacement and the attendant marring of the exterior surface. This approach also overlooks the fact that as long as the stucco layer is bonded to wall panels that move, the stucco layer will be forced to move as well, often resulting in partial separation from the underlying substrate since it is not allowed to float above unaffected by the movements of the wall panels. For this reason this approach is likely to have very limited application restricted solely to structures where wall panels do not move appreciably, and such structures are few indeed. Furthermore, this approach does not eliminate the need for installing water resistant layers, but rather adds at least one additional layer that is installed along the panel joints to separate the stucco layer from the panel edges.

New housing is being erected throughout the civilized world at an accelerating rate, and the level of comfort and durability demanded of such structures is increasing as well. What is urgently needed is an attractive exterior wall that is low cost, adaptable and easy to install but offers much improved moisture protection, impact and abrasion resistance, and resistance to freeze/thaw cycles.

SUMMARY OF THE INVENTION

The method of the present invention is characterized by an exterior synthetic stucco wall construction wherein cementitious wall board panels are selected having an exterior synthetic stucco receiving surface possessing a known moisture absorption characteristic, and selecting an elastomeric adhesive joint sealing tape for covering gaps formed between adjacent edges of wall panels and having a selected moisture absorption characteristic. Synthetic stucco mix of the type including components of water based resinous latex, coalescing agents, dispersants, defoamers, surfactants and inert fillers is mixed with such components in a ratio to, when applied to the synthetic stucco receiving surfaces and over the joints covered by the sealing tape, cure to form a strong bond and exhibit flexibility, water resistance, and substantially uniform exterior appearance.

The present invention preferably includes cementitious fiber wall board panels that are free of asbestos and other inorganic fibers, and are environmentally safe to install. The cementitious wall board panels provide an excellent bonding surface for the synthetic stucco mix and impart additional flame retardant properties to the wall. The panels are installed on wood or metal frame structures with small gaps between the panels. Polyurethane caulk is applied to the gaps between the panels and allowed to cure. Polyurethane caulk remains flexible once it has cured and usually maintains, although not always, its integrity when the wall panels settle or move due to seasonal temperature variations. The elastomeric adhesive joint sealing tape applied over adjoining edges of panels to cover all gaps and corners has a thin fabric backing that allows minimal amounts of water to be absorbed from the synthetic stucco layer. The elastomeric adhesive on the tape provides a water tight seal along the joints and ensures that any water that permeates the synthetic stucco layer does not infiltrate through the joints to the interior walls of the building.

The synthetic stucco mixture is applied by trowel or sprayer on the outer surface of the panels and the tape, and can be finished to the desired texture. The fabric backing of the sealing tape provides a flat porous surface that the overlying synthetic stucco coat bonds and adheres to regardless of any movement or settling of the underlying panels and caulk. Because the tape has a very low profile the synthetic stucco coating does not 'ride up' and bulge over the tape even when the coating is very thin, and there is no need for applying the traditional bedding coat to disguise the presence of the tape. The synthetic stucco mixture cures as water evaporates from it or is absorbed by the underlying wall panels and the fabric backing of the adhesive tape. Because the fabric backing of the tape also absorbs water from the synthetic stucco mixture, it prevents non-uniform appearance in the outer surface of the synthetic stucco coat in the vicinity of the panel joints due to unequal water absorption.

The synthetic stucco mixture is preferably an acrylic or other compatible water based resinous latex emulsion containing calcium carbonate or other non-reactive sand. The mixture bonds extremely well to the wall panels and to the fabric backing of the elastomeric sealing tape and eliminates the need for the conventional bonding or primer coats between the synthetic stucco and the underlying substrate. In addition, the latex in the mixture provides an effective barrier against water infiltration. The addition of latex also results in a mixture that remains flexible when cured and thus offers significantly improved abrasion and impact resistance, is highly resistant to damage from repeated freeze/thaw cycles, and is unaffected by most chemicals. The present invention therefore provides a method for producing a synthetic stucco finished exterior wall with a single coat application of synthetic stucco mix that does not require the installation of water barriers nor the use of bonding or primer coats. This is an extremely significant improvement in stucco wall technology and greatly extends the range of projects that can now employ a stucco-like material and reap its traditional advantages as well as the new benefits disclosed herein.

Furthermore, the latex employed is water based and the mixture is environmentally safe to apply. In addition, latex emulsions are compatible with a wide range of coloring agents and the synthetic stucco finish can therefore be manufactured and applied in virtually any color desired.

The apparatus of the present invention is characterized by a synthetic stucco applied to a cementitious wall board panels having a predetermined moisture absorption characteristic and joint sealing tape having a selected moisture absorption characteristic properly mounted to a building frame. The wall panels and the tape sealing the joints formed between the panels are covered by a predetermined thickness of a water based latex stucco mixture having the components thereof mixed in such a ratio that when applied to the panels and tape, cures to form a strong bond and exhibit relative flexibility, water resistance, and uniform exterior appearance.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENT

Stucco facing is one of the most popular methods of finishing the exterior walls of residential and commercial structures due to the ease and flexibility of application, relatively low cost, and wide range of possible finishes. However, conventional stucco facings are water permeable and typically require expensive moisture barriers installed. Because conventional stucco is brittle it is very susceptible to repeated freeze/thaw cycles and offers little impact and abrasion resistance. In addition, conventional stucco does not bond well to moisture barrier materials and requires additional special bonding layers that are time, material, and labor intensive. The method of the present invention provides steps for producing an external wall with a synthetic stucco facing that reduces or eliminates many of the shortcomings of conventional stucco in an easy to implement, cost effective manner.

Figure 1:
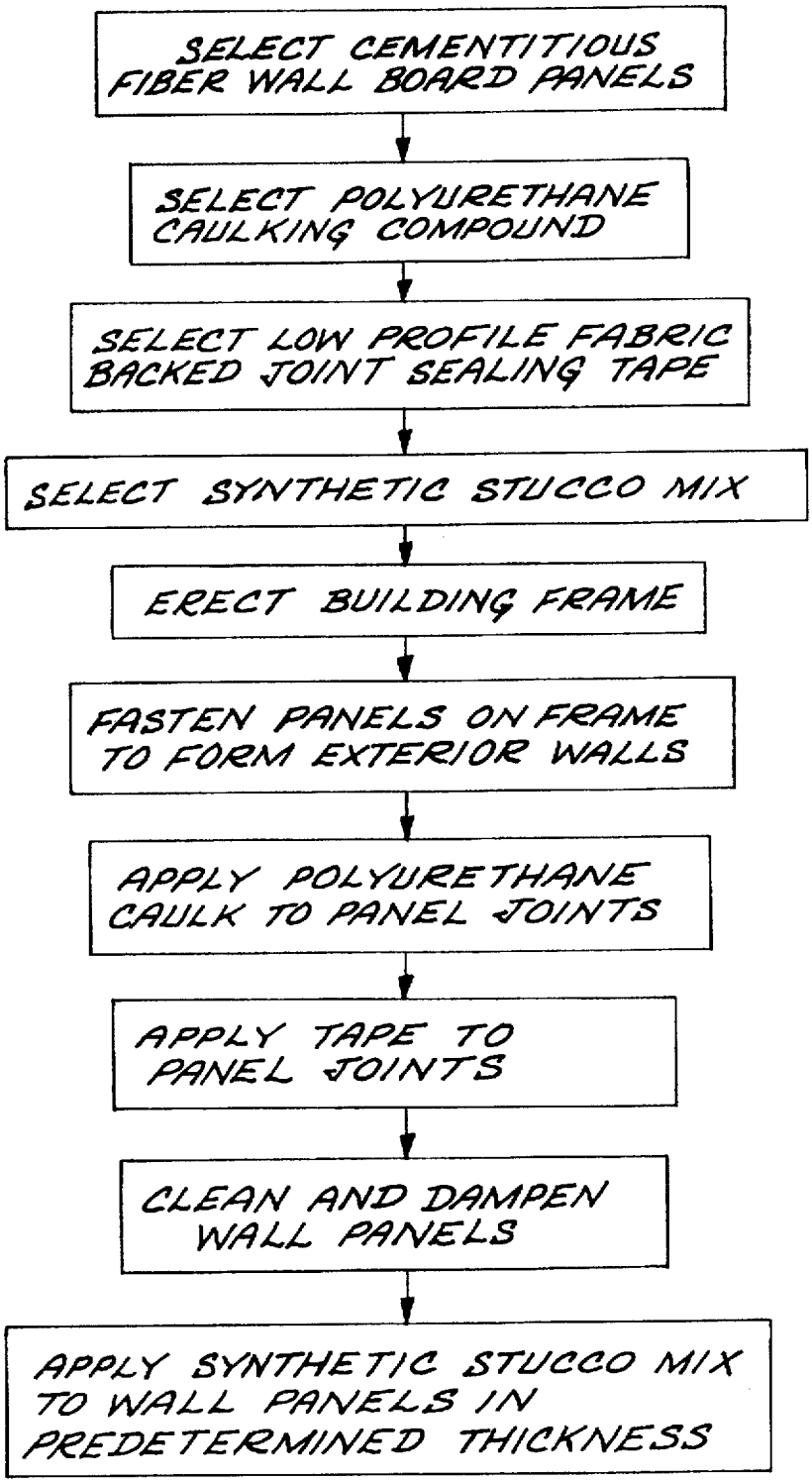
FIG. 1 is a block diagram depicting one embodiment of the method of the present invention.
Figure 2:
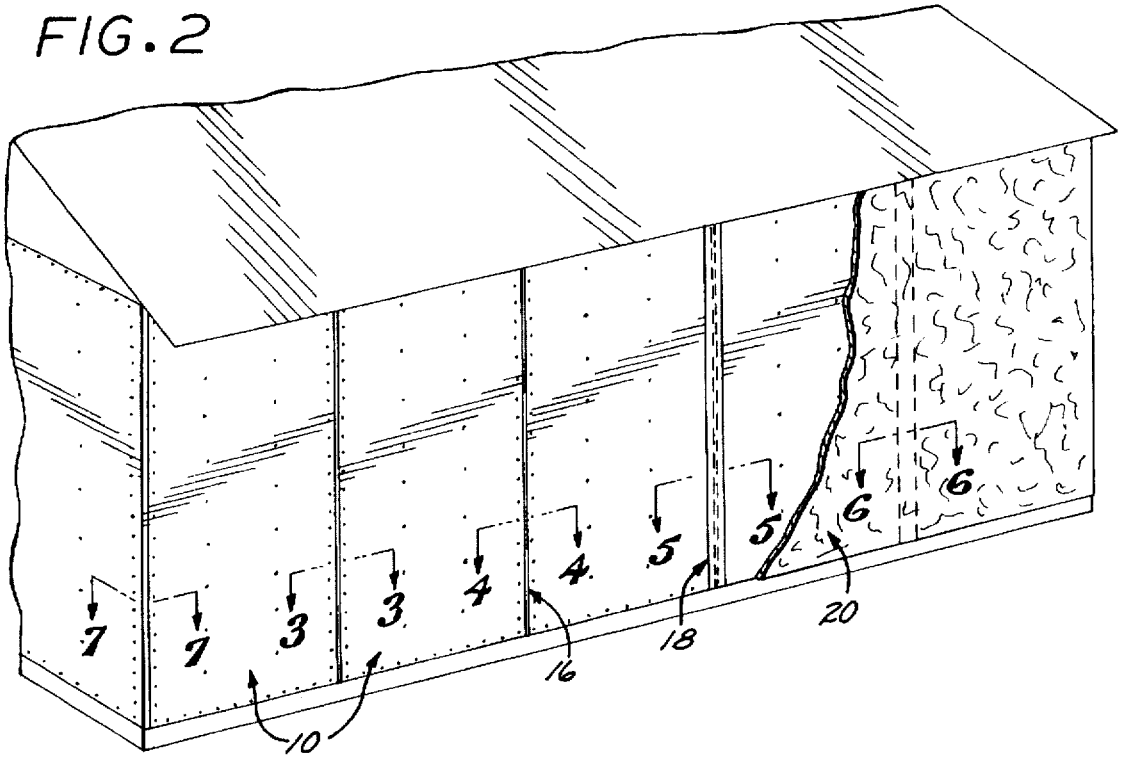
FIG. 2 is a perspective view of a partially broken away building with a stucco wall embodying the present invention.

Referring to FIGS. 1 and 2, the present invention entails, generally, selecting cementitious fiber wall board panels of a known low moisture absorption characteristic and forming walls by installing such panels 10 on to a building frame 12 with small gaps between the edges of adjacent panels. Polyurethane caulking compound 16 is applied in the gaps and allowed to cure. A low profile fabric backed joint sealing tape 18 of a selected moisture absorption characteristic is applied over adjoining edges of the panels 10 to cover the gaps therebetween. A high build flexible resinous latex emulsion is applied to the exterior surface of the panels 10 and the tape 18 and finished to the desired texture to form an exterior synthetic stucco facing 20.

Referring to FIG. 2, the initial step consists of the erection of a building frame 12 by carpenters or other skilled personnel. The frame may be of wood or metal or any combination thereof. The frame design and erection as well as the materials employed must be in accordance with applicable codes and standards.

Following erection of the frame 12 the panels 10 must be selected. The panels 10 selected have a known moisture absorption characteristic and are preferably light weight, non-combustible, cementitious fiber wall boards that contain no asbestos or other inorganic fibers. Such panels should offer enhanced moisture tolerance, be resistant to termites, chemicals, and repeated freeze/thaw cycles, and preferably offer little or no flame spread or smoke generation. It is important that the panels have excellent bonding compatibility with water based synthetic stucco compounds and therefore preferably incorporate materials such as cement, cellulose fibers, and silica-sand. The panels should offer a smooth outer surface for an improved bond with the synthetic stucco facing. A commercially available product such as wall board sold under the trade name MaxiPanel by MaxiTile, Inc., 17141 Kingsview Ave., Carson, Calif., 90746, is ideal for use in the present invention as the panels 10.

Figure 3:
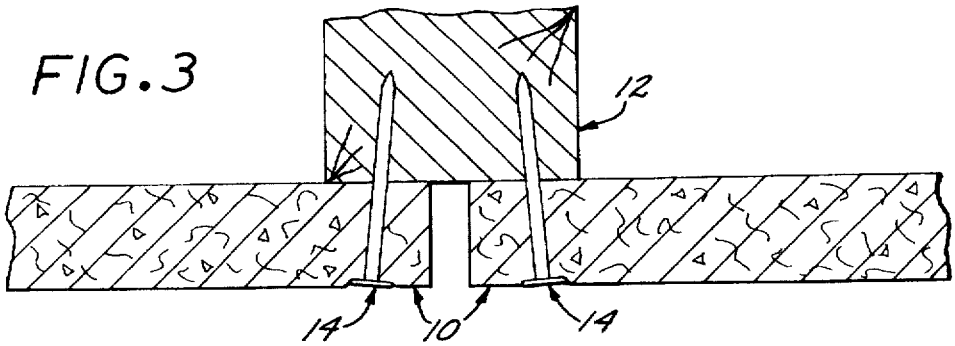
FIG. 3 is a cross sectional view in enlarged scale taken along line 3—3 of FIG. 2.

Referring to FIGS. 2 and 3, the panels 10 are next installed onto the frame 12 to form exterior walls. The panels 10 can also be installed over existing walls formed of plywood, drywall, or any other substrate. The panels 10 must be installed according to the manufacturer's instructions and applicable building codes using the required or recommended types of fasteners 14, and should be installed a minimum of ⅛" apart. It is preferred that the fasteners 14 be installed flush with the surface of the panels 10 to allow better coverage by the synthetic stucco mix 20 and thus offer better resistance to water infiltration. Expansion joints should be provided approximately every 16 feet for walls with no openings such as doors or windows.

Figure 7:
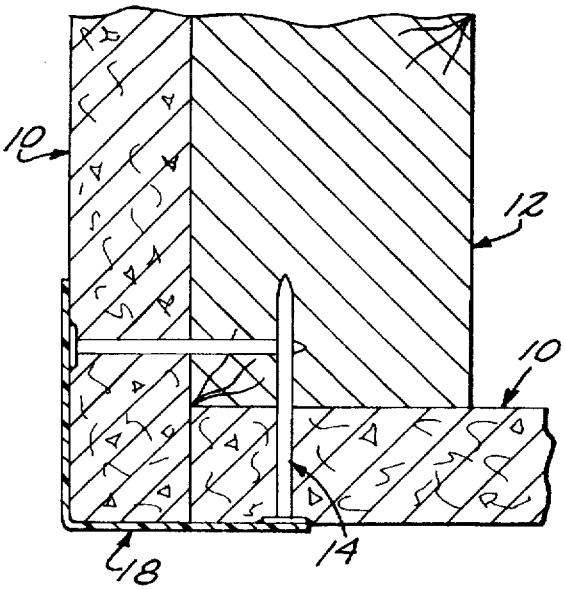
FIG. 7 is a cross sectional view in enlarged scale taken along line 7—7 of FIG. 2.
Figure 8:
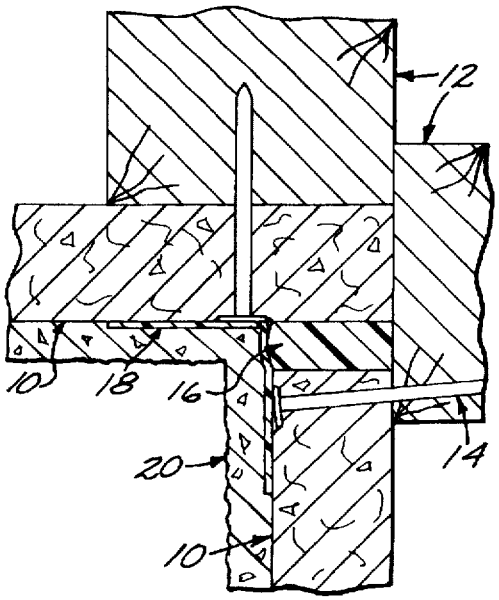
FIG. 8 is a cross sectional view in enlarged scale of an internal corner of the building shown in FIG. 2.

Referring to FIGS. 7 and 8, lateral corners formed by two adjacent panels 10 must also have a minimum gap space of ⅛" between the two panels 10. However, external corners that are formed by two adjacent panels 10 must offer continuously flush surfaces for application of the latex emulsion 20, with no gap space between the panels 10.

Figure 4:
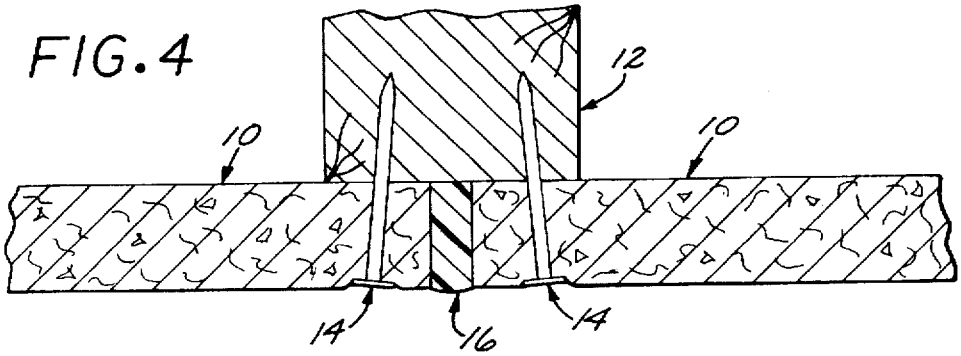
FIG. 4 is a cross sectional view in enlarged scale taken along line 4—4 of FIG. 2.

Referring to FIG. 4, after the panels 10 have been installed on the frame 12 a caulking compound 16 is applied in the joints between the panels 10. The purpose of the caulking compound 16 is to seal the panel joints. The caulking compound must be installed according to the manufacturer's specifications and directions, and must be allowed to cure fully prior to proceeding with the next step. The caulk 16 can be either slow or fast setting, and can be any standard, commercially available polyurethane caulk such as Trintex 25 available from Tremco Company in Cleveland, Ohio. The use of polyurethane caulk is preferrable because such caulk remains flexible even when fully cured and usually accommodates movements of the panels 10.

Figure 5:
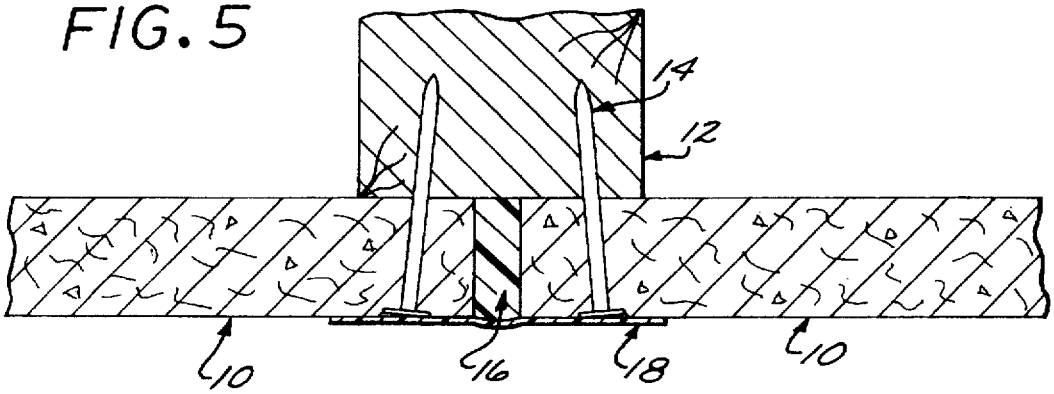
FIG. 5 is a cross sectional view in enlarged scale taken along line 5—5 of FIG. 2.

Referring to FIG. 5, the next step consists of selecting a joint sealing tape with specific water absorption and other characteristics as described below. The tape 18 is installed over the joints formed by adjacent edges of panels 10 to cover the cured caulk 16 therein. The adhesive tape is preferably composed of an elastomeric butyl rubber or other compatible synthetic rubber self adhesive on a fabric backing such as of wood fibers and spun polyester, and has a very low profile such as 13 mils or less. Synthetic rubber elastomers such as butyl rubber offer aggressive, water tight bonds and when used together with polyurethane caulk act to prevent water infiltration through the joints, a chronic problem with conventional stucco finish systems.

The use of a joint sealing tape in addition to a caulking compound is highly desirable for a number of reasons. Chief among these is the fact that wall panels tend to shift during the life of the building due to settling and seasonal variations in temperature, and the joints between the panels must accommodate these movements. Soft curing compounds such as polyurethane caulk tend to bulge when squeezed together and stretch out when pulled apart. Under either circumstance the caulk gives rise to irregularities such as cusps or depressions on the outer surface of a stucco coat around the joint areas that significantly and permanently alter the outward appearance of the stucco finish. Furthermore, because caulk is water proof it does not absorb water from the overlying stucco mix, and once cured the stucco coat tends to exhibit non-uniform appearance in the areas overlying the panel joints. Applying a tape over the joints, however, provides a flat surface that is more likely to accommodate the movements of the underlying wall panels and not disturb the overlying materials. A tape will also provide water resistance at the joints, as well as enhance the mechanical strength of the joints and thus help minimize unequal movements of the wall panels 10.

The fabric backing of the adhesive tape also offers a host of advantages over other types of joint sealing tapes. Fabric has high tensile strength and thus offers excellent resistance to ripping and excessive distortion or stretching. The use of a fabric backed adhesive tape therefore adds strength and crack-resistance to the panel joints. In addition, the high tensile strength of the fabric allows it to resist tearing from tools and lie flat during installation.

The permeability of the fabric backing also plays a crucial role during the curing stage of the synthetic stucco mix. The synthetic stucco mix cures as water evaporates through its exposed surface or is absorbed from it by the underlying substrate. A chronic problem encountered when using joint sealing tape is uneven water absorption by the underlying substrate, which is usually permeable, and the tape, which is usually not permeable. This uneven water absorption leads to unequal curing rates and results in non-uniform appearance along the outer surface of the stucco finish in the areas overlying the joint sealing tape, thereby substantially compromising the esthetic appeal of the stucco finish. This very serious problem is solved by the present invention through the use of a joint sealing tape with a fabric backing that absorbs water from the synthetic stucco mix selected for the particular application at a rate substantially matching that of the wall panels, and thus allows the cured synthetic stucco to exhibit an even outer appearance in the areas overlying the panel joints and adjacent panels.

Because the fabric backing is permeable, it also offers an excellent bonding surface for the synthetic stucco mix. The synthetic stucco mix is applied in a plastic state and thus permeates the fabric backing and cures to form a homogeneous, strong, highly water resistant bond. The synthetic rubber adhesive ensures a very strong grip onto the panels 10, and there is essentially no difference between the direct bond formed between the synthetic stucco coat 20 and the panels 10, and the bond between the synthetic stucco coat 20 and the adhesive tape 18 at the panel joints. Because of this very strong, homogeneous bond the flexible synthetic stucco coat 20 accommodates normal movements of the underlying substrate along the entire wall length without cracking, deformation or outright delamination along the joints. The strength and homogeneity of the bond also allows the synthetic stucco coat to impart additional structural strength to the walls it is covering, and thereby helps minimize unequal movement of the wall panels 10 and the attendant joint movement problems. Other joint sealing tapes such as paper backed tapes may not offer this advantage because the paper backing is usually coated with a water repellant and cannot be permeated by the fluid stucco mix, and therefore the bond formed between the stucco mix and the paper backed tape is inferior in strength and durability while the outer surface of the cured stucco finish may exhibit a non-uniform appearance as mentioned above.

The use of adhesive tape to join wall panels prior to applying an outer coating is well known in the art, and so are the attendant problems of discoloration, delamination, joint cracking, and water infiltration. It has now been determined that a fabric backed, elastomeric butyl rubber or other compatible synthetic rubber adhesive tape as described on the order of about 13 mils or less total thickness has the proper characteristics necessary, in combination with the synthetic stucco mix used, to solve these problems. In practice, it will be appreciated by those skilled in the art that the thickness of such tape may be varied depending on the make up of the synthetic stucco mixture as described below. It has been found that the tape thickness should be less than 20 mils to exhibit the necessary absorption characteristics and should be at least 10 mils to exhibit the required structural characteristics. Mixing stucco batches with a variety of ratios of components as described below may be necessary due to normal variations in raw material supplies. In such cases test areas prepared from each batch of said raw materials are applied at the desired thickness over tape at the joints between test panels and the adjacent wall panels. The test areas are then allowed to cure and examined for the continuity of the finished surface. Those skilled in the art can then select the synthetic stucco formulation which produces a cured finish surface with a uniform appearance in the surface of the stucco in the area over the tape and the adjacent panel area, and can then proceed to duplicate the batch or batches having the ratios of components resulting in a satisfactory finish surface. Thus, the present invention allows those skilled in the art to now produce one coat synthetic stucco walls that retain their outward beauty and their inner structural integrity over time and under adverse conditions. The present invention therefore provides a method for significantly enhancing the esthetic appeal as well as the performance of outer wall synthetic stucco facings.

In practice, the preferred adhesive tape 18 is that sold under the trade name Multicoat Elastomeric Joint Tape available from applicant Multicoat Corporation of Costa Mesa, Calif. The adhesive tape 18 to be applied over the gaps between coplanar panels 10 is preferably approximately 3" wide to ensure adequate adhesion to the panels and a water tight seal, and the adhesive tape 18 applied over corners formed by two adjacent panels 10 is preferably 6" wide.

The next step after applying the joint sealing tape 18 consists of preparing a synthetic stucco mix that when applied at the desired thickness to the walls of the building will cooperate with the outer surface of the panels 10 and the exposed fabric backing of the tape 18 to, upon curing, produce a strong, homogeneous, water resistant bond and a uniform exterior surface in the areas overlying the tape and the adjacent panel surfaces. Commercial grade synthetic stucco mixes typically vary in their characteristics from batch to batch and are highly dependent on the properties of the particular components and the ratios in which they have been added to the mixture. For batches of the synthetic stucco mixture of the present invention the ratio of the various ingredients must be adjusted in a known manner because of normal variations in raw materials to provide the resultant mixture with characteristics such that, when applied over the wall panels and sealing tape and allowed to cure, will form a synthetic stucco coat that is water resistant, durable, flexible, and presents a uniform outer appearance from the areas overlying the sealant tape to the areas overlying the adjacent panels. It has been discovered that by selecting wall board of the type described and sealing tape as characterized in the disclosure, the ratio of components in the synthetic stucco mixture can be adjusted by those familiar with mixing synthetic stucco material to provide the desired characteristics of bonding strength, impermeability, flexibility, durability, and uniform outer appearance without the need for primer, bond, or barrier layers. Those skilled in the art will recognize that in practicing the present invention if the mixture exhibits unwanted characteristics upon the curing of a test batch, the component ratio can be adjusted in a known manner to eliminate the defect and provide the desired results.

The preferred synthetic stucco mix consists of an acrylic or other compatible resinous latex emulsion prepared primarily by combining a water based acrylic or other compatible resinous latex with a calcium carbonate or other inert sand. The sand is applied in various mesh sizes as dictated by the roughness of the final synthetic stucco finish desired. Varying amounts of coalescing agents, dispersants, defoamers, and surfactants are added to the latex and sand mixture in proportions understood by those skilled in the art as necessary to account for variations in the raw materials used and to achieve the desired mixture characteristics as described in the disclosure. Bacteria and fungus control agents are also added to the mixture to enhance the resistance of the synthetic stucco finish to such environmental hazards. The resultant mixture is compatible with most coloring agents and the synthetic stucco finish can be manufactured and applied in any color desired.

The latex in the mixture provides a highly effective barrier against water infiltration, and is tough and durable and thus significantly improves abrasion and impact resistance. The addition of latex also results in a mixture that remains flexible when cured and thus further enhances its impact resistance as well as renders it highly resistant to cracks and repeated freeze/thaw cycles. The synthetic stucco coat is also unaffected by most chemicals, including salts, oils, and solvents. In addition, the tough and flexible latex makes the synthetic stucco coat virtually impenetrable to insects and turns it into an unexpected but very effective barrier against termites. Furthermore, cementitious fiber wall boards of the type described offer excellent bonding characteristics for selected resinous latex based compounds and the preferred synthetic stucco mixture as described in the disclosure forms an excellent bond directly with the wall panels 10 and the joint sealing tape 18 without the use of bond or primer coats, or multiple coats of stucco mix.

All ingredients of acrylic or other selected latex emulsions are commercially available. The preferred embodiment of the latex emulsion includes Rohm and Haas MC-76 water base latex, calcium carbonate sand from Specialty Minerals Inc., Eastman Chemical Texanol coalescing agent, Rhone-Polenc Colloid 610 surfactant, Rhone-Polenc Colloid 226 dispersant, Rhone-Polenc Colloid 643 defoamer, Henkel Nopcocide N-96 mildicide, and Huls America Nuo-sept 95 bacticide.

The next step consists of cleaning the panels 10 with a water-dampened sponge and left slightly damp. It is critical that the panels 10 are free of grease, oil, paint, dirt, dust, sealers, and any other foreign substances that may prevent proper bonding of the synthetic stucco mixture 20. The synthetic stucco mixture 20 is next applied to the panels 10 while they are still slightly damp because the water on the surface of the panels 10 enhances the bond formed between the synthetic stucco mix and the cementitious fiber panels.

Figure 6:
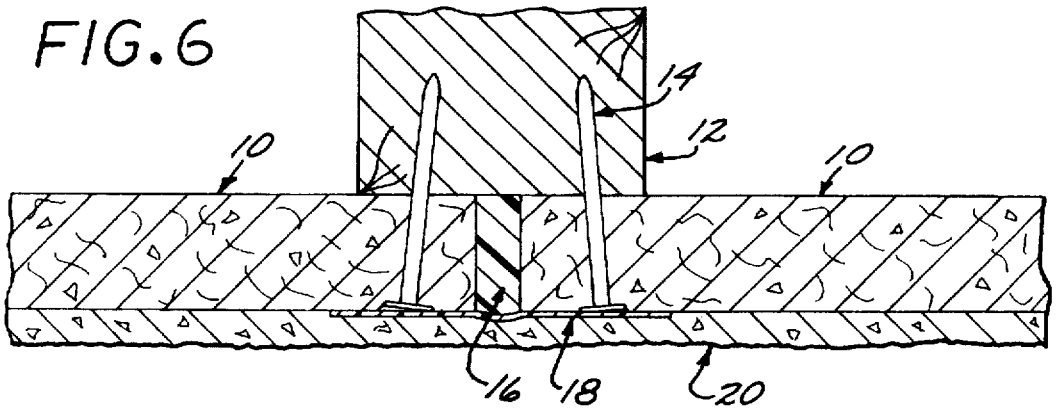
FIG. 6 is a cross sectional view in enlarged scale taken along line 6—6 of FIG. 2.

Referring now to FIG. 6, the synthetic stucco mixture 20 is applied in a single coat and thereby eliminates the time and labor necessary for applying multiple coats. In addition, there is no need for a primer, base or bond coat between the latex emulsion 20 and the panels 10, resulting in further materials and labor savings when compared to conventional stucco facings. The synthetic stucco mixture 20 can be applied by trowel or with a sprayer to a conventional thickness. The final finish may be textured as desired. When a smoother finish is preferred, a second thin coat of latex emulsion 20 may be applied.

From the foregoing, it will be appreciated that the present invention offers a profound advantage over conventional stucco finishes by eliminating the need for moisture barriers, bond or primer coats, and multiple coats of stucco mix. The present invention teaches the formation of a synthetic stucco finish with significantly enhanced properties in a single coat application, and thereby offers substantial savings over the prior art both in the near term and over the life of the structure thus covered. The invention relies on commercially available materials that are easy and environmentally safe to use and apply. The synthetic stucco finish produced by the method of the present invention is weather, pest, and shock resistant, and cures with a uniform outward appearance that does not deteriorate with time. The present invention therefore effectively and significantly advances the state of the art of residential and commercial construction by successfully addressing a number of long recognized but hitherto unsolved problems.

While a particular embodiment of the invention has been illustrated and described, various modifications can be made without departing from the spirit and scope of the invention, and all such modifications and equivalents are intended to be covered.

What is claimed is:

1. A method of making a synthetic stucco covered wall on a building frame including the following steps:

selecting a plurality of wall board panels having a predetermined fluid absorption characteristic;

positioning said panels edgewise to one another on said frame to form narrow gaps therebetween;

selecting a caulking compound compatible with said panels;

applying said caulking compound to said gaps;

selecting an adhesive sealing tape having sufficient width to span said gaps and adhere to adjacent edges of said panels and having a predetermined thickness, said tape having a selected fluid absorption characteristic;

applying said tape to said adjacent edges of said panels to cover said gaps and form respective panel joints;

selecting a synthetic stucco mixture of inert sand, water based resinous latex, coalescing agents, dispersants, defoamers and surfactants mixed in a ratio sufficient to, when applied to said panels and panel joints at a predetermined thickness and cured, adhere to said panels and panel joints and form a moisture resistant layer exhibiting a uniform outward appearance; and applying said synthetic stucco mixture directly to said panels and panel joints to said predetermined thickness.

2. A method as set forth in claim 1, wherein:

said selection of said tape includes selecting a tape having a total thickness of substantially 0.013 inches.

3. A method as set forth in claim 1, wherein:

said selection of said tape includes selecting a tape constructed of a synthetic rubber adhesive on a fabric backing.

4. A method as set forth in claim 3, wherein:

said synthetic rubber adhesive is an elastomeric modified butyl rubber adhesive.

5. A method as set forth in claim 1, wherein:

said selection of said panels includes selecting panels constructed of cement, sand and organic fibers.

6. A method as set forth in claim 1, wherein:

said selection of said caulking compound includes selecting a polyurethane caulking compound.

7. A method as set forth in claim 1, wherein:

said selection of said tape includes selecting a tape constructed of an elastomeric modified butyl rubber adhesive on a fabric backing and having a total thickness of substantially 0.013 inches;

said selection of said caulking compound includes selecting a polyurethane caulking compound; and said selection of said panels includes selecting panels constructed of cement, silica-sand and cellulose fibers.

8. A method as set forth in claim 1 wherein:

said selection of said synthetic stucco mixture includes selecting a synthetic stucco mixture manufactured with bacticide and mildicide agents.

9. A method as set forth in claim 1 wherein:

said selection of said synthetic stucco mixture includes selecting a synthetic stucco mixture manufactured with calcium carbonate sand.

10. A method as set forth in claim 1 wherein:

said selection of said synthetic stucco mixture includes selecting a synthetic stucco mixture manufactured with water based acrylic latex.

11. A synthetic stucco covered wall on a building frame, comprising:

a plurality of wall board panels having a predetermined fluid absorption characteristic and positioned edgewise on said frame to form narrow gaps therebetween;

a caulking compound applied to said gaps;

an adhesive sealant tape of predetermined thickness applied to adjacent edges of said panels and covering said gaps to form respective panel joints, said tape having a selected fluid absorption characteristic; and a moisture resistant synthetic stucco layer of inert sand, water based resinous latex, coalescing agents, dispersants, defoamers and surfactants, adhered directly to said panels and panel joints and having a uniform outward appearance.

12. A synthetic stucco wall as set forth in claim 11, wherein:

said tape has a total thickness of substantially 0.013 inches.

13. A synthetic stucco wall as set forth in claim 11, wherein:

said tape is constructed of synthetic rubber adhesive on a fabric backing.

14. A synthetic stucco wall as set forth in claim 13, wherein:

said synthetic rubber adhesive is an elastomeric modified butyl rubber adhesive.

15. A synthetic stucco wall as set forth in claim 11, wherein:

said panels are constructed of cement, sand and organic fibers.

16. A synthetic stucco wall as set forth in claim 11, wherein:

said caulking compound is a polyurethane caulking compound.

17. A synthetic stucco wall as set forth in claim 11, wherein:

said tape is constructed of an elastomeric modified butyl rubber adhesive on a fabric backing and has a total thickness of substantially 0.013 inches;

said caulking compound is a polyurethane caulking compound; and said panels are constructed of cement, silica-sand and cellulose fibers.

18. A synthetic stucco wall as set forth in claim 11, wherein:

said synthetic stucco mixture is manufactured with bacticide and mildicide agents.

19. A synthetic stucco wall as set forth in claim 11, wherein:

said synthetic stucco mixture is manufactured with calcium carbonate sand.

20. A synthetic stucco wall as set forth in claim 11, wherein:

said synthetic stucco mixture is manufactured with water based acrylic latex.

* * * * *